United States Patent [19]

Buck, Jr. et al.

[11] 4,053,673

[45] Oct. 11, 1977

[54] GLOW-RESISTANT BATT AND PROCESS FOR PRODUCING SUCH

[75] Inventors: George Sumner Buck, Jr.; Robert George Weyker, both of Memphis; Arthur Gerard Ward, Arlington, all of Tenn.

[73] Assignee: Fiberlok, Inc., Memphis, Tenn.

[21] Appl. No.: 612,785

[22] Filed: Sept. 12, 1975

[51] Int. Cl.[2] ..... B32B 31/00

[52] U.S. Cl. ..... 428/283; 156/62.2; 156/62.6; 156/283; 156/320; 264/122; 428/288; 428/327; 428/339; 428/360; 428/372; 428/920

[58] Field of Search ..... 156/62.2, 62.6, 283, 156/360; 428/206, 296, 288, 283, 289, 290, 302, 327, 360, 372, 381, 920, 921, 339; 252/8.1; 106/15 FP; 264/122

[56] References Cited

U.S. PATENT DOCUMENTS

| | | | |
|---|---|---|---|
| 2,568,144 | 9/1951 | Cremer et al. | 428/360 |
| 2,808,098 | 10/1957 | Chavannes et al. | 156/62.6 |
| 2,972,554 | 2/1961 | Muskat et al. | 428/360 |
| 3,033,726 | 5/1962 | Howden | 156/62.6 |
| 3,117,055 | 1/1964 | Guandique et al. | 428/290 |
| 3,369,948 | 2/1968 | Ostmann | 428/296 |
| 3,497,454 | 2/1970 | Perrizzolo | 252/8.1 |
| 3,498,875 | 3/1970 | Lindemann et al. | 428/283 |
| 3,498,877 | 3/1970 | Christoffersen et al. | 252/8.1 |
| 3,753,826 | 8/1973 | Plummer | 428/206 |

FOREIGN PATENT DOCUMENTS

| | | | |
|---|---|---|---|
| 550,712 | 12/1957 | Canada | 156/62.6 |

*Primary Examiner*—James J. Bell
*Attorney, Agent, or Firm*—Littlepage, Quaintance, Murphy, Richardson & Webner

[57] ABSTRACT

A glow-resistant batt of fibers; a copolymer of vinyl chloride and vinylidene chloride; and diammonium phosphate; and processes for producing such.

10 Claims, 4 Drawing Figures

FIG. 1
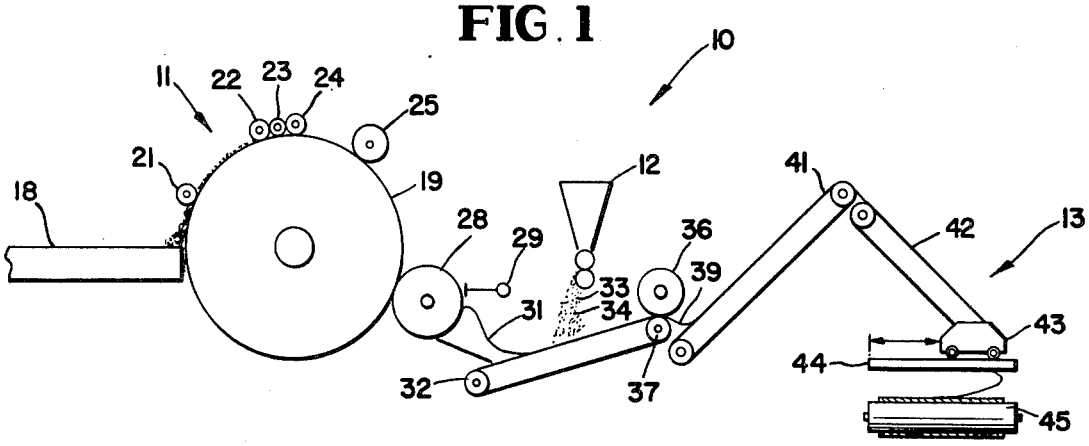
FIG. 2
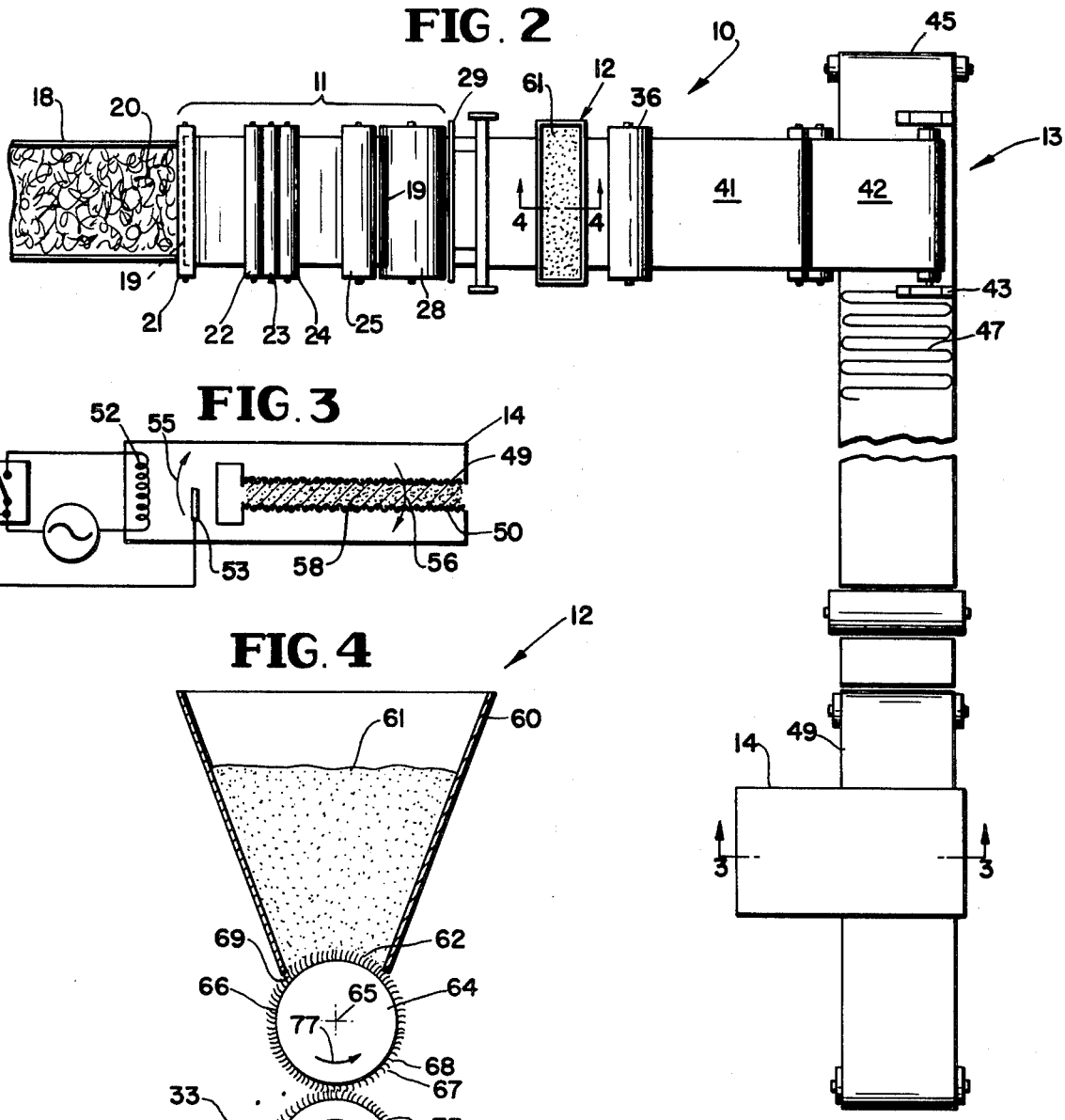
FIG. 3
FIG. 4
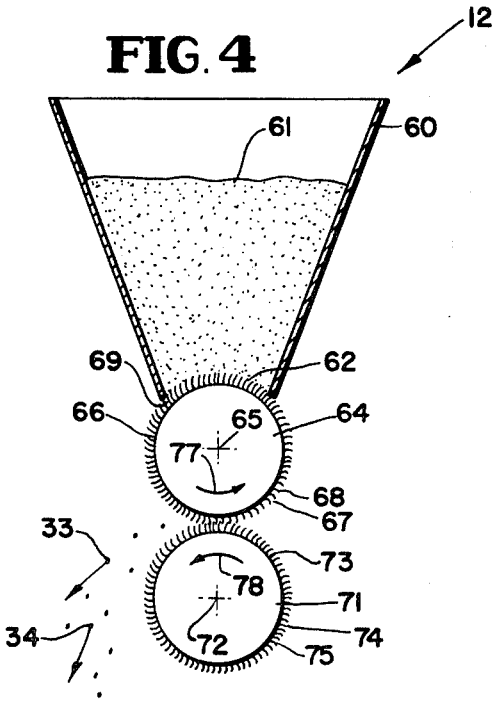

GLOW-RESISTANT BATT AND PROCESS FOR PRODUCING SUCH

A process is described and claimed in U.S. application Ser. No. 507,485 filed Sept. 19, 1974 now U.S. Pat. No. 3,993,518. This process employs a copolymer of vinyl chloride and vinylidene chloride in order to bond fibers at their intersections. Unfortunately, such a process produces a batt which may not be glow-resistant when the copolymer comprises only 25% of the batt.

It is known to employ boric acid in a dry process for the purpose of imparting glow-resistance to a batt such as a cotton batt. Other compounds are also known, but other considerations such as toxicity render them unsuitable for use in batts. Boric acid is considered slightly toxic to young children. Also, when boric acid is used alone for imparting glow resistance it is necessary to employ a great amount, possibly from 10 to 12 weight percent of the batt. It is, of course, very expensive to employ such a great amount of boric acid. Boric acid by itself has a tendency to sublime at room temperature and it is possible to experience a loss of one-quarter of the material in the space of six months.

The present invention employs an alternative compound, diammonium phosphate, in conjunction with a copolymer of vinyl chloride and vinylidene chloride, that renders a batt glow-resistant. The diammonium phosphate is co-applied with the polymer and is fused solidly in place, thereby rendering it relatively nonvolatile and leach-resistant.

It is, therefore, an object of the present invention to provide an improved batt and a process for producing such which is substantially free of the disadvantages of known batts and known processes.

Another object is to provide an improved process for the production of a fibrous batt which employs diammonium phosphate with a copolymer as a glow-resistant additive.

Additional objects and advantages of the present invention will be apparent to those skilled in the art by reference to the following detailed description and drawings wherein:

FIG. 1 is an elevation view of an apparatus suitable for practicing the process of the present invention.

FIG. 2 is a plan view of the apparatus of FIG. 1.

FIG. 3 is a sectional view taken along line 3—3 of FIG. 2.

FIG. 4 is a sectional view taken along line 4—4 of FIG. 2.

It was expected that diammonium phosphate would render a batt glow-resistant. However, according to the present invention, it has been discovered additionally that the copolymers employed in the instant case and diammonium phosphate have a synergistic effect. For example, 6% of diammonium phosphate is insufficient to impart glow-resistance to a cotton batt in the absence of the herein described copolymers. Likewise, 20% of the herein described copolymers is insufficient to impart the optimum desired glow-resistance. On the other hand, employing 2% of diammonium phosphate with 20% of copolymer does impart sufficient glow-resistance. This is particularly surprising since replacement of the diammmonium phosphate with an equivalent amount of copolymer, i.e., a batt having 22% copolymer, likewise does not have the optimum desired glow-resistance. Although the mechanism is not completely understood, it is believed that the glow-resistance imparting properties of the copolymer and the diammonium phosphate are synergistic.

According to the present invention, batts are produced by first forming a thin web of fibers. This thin web of fibers is then contacted with an adhesive amount of the copolymer. The web is also contacted with a glow-resistance imparting amount of diammonium phosphate. The contacting of the web with the copolymer can precede the contacting of the web with the diammonium phosphate. The reverse is also true. However, the contacting is preferably accomplished by mixing the copolymer and the diammonium phosphate in the desired ratios. In the broadest aspects of the present invention, weight ratios of copolymer to diammonium phosphate of 100:4 to 100:4 can be employed, but this ratio is preferably maintained between 100:8 and 100:20.

After the contacting, the web is formed into a batt and then heated to a temperature above the sticking point of the copolymer, but below the degradation point of the fibers.

A wide variety of fibers can be employed in the present invention. Thus, the fibers can be those of nylon, acrylics, modacrylics, polyesters, cotton or blends thereof. The cotton fibers useful to produce the thin web can be cotton from any source. In fact, the present invention provides a valuable process for employing inexpensive cotton fibers, also referred to as linters or picker-lap. For reasons explained more completely below, the thin web is generally only from 1 to 200 and preferably from 1 to 100 fibers thick.

After the copolymer and the diammonium phosphate are contacted with the web, the web is formed into a batt. It is impractical to contact the copolymer and the diammonium phosphate with the preformed batt since it is difficult or impossible to insure penetration of the particles into the batt. As used herein, a batt is meant to refer to a plurality of webs.

The batt, formed as described above, is then heated to a temperature above the sticking point of the copolymer but below the scorching point of the fibers and generally at a temperature of 300° to 400° F and preferably at 325° to 375° F. At much lower temperatures, the copolymer does not melt whereas at higher temperatures, the fibers are adversely effected. The heating is conducted for a time sufficient to effect the desired melting of the copolymer which generally occurs within a period of from 1 to 20 minutes, preferably 2 to 10 minutes.

The diammonium phosphate useful in the present invention can be pure diammonium phosphate or can contain the impurities normally associated with commercial diammonium phosphate. The diammonium phosphate generally comprises 1 to 6, and preferably comprises 2 to 4, weight percent of the batt.

The copolymer generally has a weight ratio of vinyl chloride to vinylidene chloride of 1:99 to 40:60 and preferably 5:95 to 25:75. At higher ratios, the copolymer exhibits no properties not separately obtained by the use of a homopolymer of vinyl chloride. Likewise, at lower ratios, i.e., less than 5:95 the copolymer exhibits the properties of the homopolymer vinylidene chloride which is an intractable, high melting material and not suitable for this process. The copolymer is applied to the web in an amount sufficient to function as an adhesive and generally in a weight ratio of the copolymer to the cotton of 1:99 to 30:70 and preferably 10:90 to 20:80. The copolymer particles generally have a size range of from 1 to 200 and preferably from 25 to 50 microns. Smaller sizes are useful technologically but are expensive to produce. Larger sizes not only unnecessarily increase the weight of the resultant batt but also reduce the number of cross-links possible with a given weight of copolymer which reduces bonding efficiency and strength. Copolymers useful in the present invention have a sticking point of from 300° to 370° F. All copolymers of vinyl chloride and vinylidene chloride useful in the present invention either have this property or can be modified to produce this property according to techniques well known in the art which form no part of the present invention. Copolymers useful in the present invention are available from the Dow Chemical Company, Midland, Michigan, under the following tradenames; Saran Resin XP-5230.04, Saran Resin XP-2384.49, Saran Resin XP-4174.19, Saran Resin XP-5230.05, Saran Resin XP-5230.06, and Saran Resin XP-5230.08.

Referring now to the drawings and in particular to FIG. 1, there is shown an apparatus 10 useful for practicing the process of the present invention. The apparatus 10 comprises an opener or a garnett 11, a particle dispenser 12, a cross-laying mechanism 13 and, as shown in FIG. 2, an oven 14. The garnett 11 comprises an inlet chute 18 adapted to feed bulk cotton to the rotating drum 19 of the garnett 11. The garnett 11 is also provided with a plurality of tooth rolls 21, 22, 23, 24, 25 which together with the teeth not shown on the drum 19 take bulk cotton 20 and convert it to a web which adheres to the drum 19. The web adhering to the drum 19 is transferred to the drum 28 where it is removed by a comb 29. The web 31 that is now only between 1 and 100 fibers thick and is barely self-supporting drops to conveyor 32 where it passes under the particle dispenser 12. While on the conveyor 32 and supported thereby, the web 31 is contacted with particles 33, 34 which fall from the particle dispenser 12 under the influence of gravity. By virtue of the fact that the web 31 is supported on the conveyor 32 the particles 33, 34 do not pass through the web 31 but rather are retained by it. To further insure rentention by the web 31 of the particles 33, 34, the web 31 is passed between the nip of two rotating rolls 36, 37; the lower roll 37 performing the dual function of providing a support for the conveyor 32. The web 39 then goes to the conveyor 41 and thence to the conveyor 42. In a manner well known in the art, the lower end of the conveyor 42 is attached to a traveller 43 which moves back and forth on the track 44. The conveyor 42 is postioned above and at right angles to the conveyor 45. The apparatus is adjusted such that the speed of the conveyor 42 is several times faster than the speed of the conveyor 45. By virtue of this arrangement, the web 39 is cross-layed back and forth on the conveyor 45 thus forming an unheat-treated batt 47. The unheat-treated batt 47 passes between an upper foraminous belt 49 and a lower foraminous belt 50 (see FIG. 3). While held between the belts 49, 50, the unheat-treated batt 47 passes into the oven 14. As shown in FIG. 3, the oven 14 is provided with heating means 52 which can be thermostatically controlled by a thermostat 53. The oven 14 is also provided with air circulating means not shown that causes the air to circulate in the direction shown by the arrows 55 and 56. The resultant product is the final heat-treated batt 58.

The details of construction of the particle dispenser 12 are shown in FIG. 4. The particle dispenser 12 comprises a container 60 containing a quantity 61 of powder. The bottom of the container 60 has an opening 62. In the embodiment shown, the opening 62 is elongated and is adapted to fit snugly to the surface of a first cyclindrical member 64. The first cyclindrical member 64 is rotatable about its axis 65. The surface 66 of the first cylindrical member 64 is provided with a means to retain the particles, herein a plurality of axially extending fibers 67, 68. The first cylindrical member 64 is positioned below the opening 62 of the container 60 but in contact with the opening 62 in the sense that the surface 66 is out of contact with the rim 69 of the opening 62 but the fibers 67, 68 are at least as long as and preferably longer than the distance between the surface 66 and the rim 69. In this manner, the only particles that can leave the container 60 are those trapped between fibers 67, 68.

The dispenser 12 also has a second cylindrical member 71 rotatable about its axis 72, the axis 72 being parallel to the axis 65. The surface 73 is likewise provided with a plurality of fibers 74, 75. However, the fibers 74, 75 are stiffer than the fibers 67, 68. The difference in stiffness can be imparted to the fibers of the apparatus in any convenient manner, however, this stiffness differential is preferably provided by selecting fibers 67, 68 that are small multifilament fibers and selecting fibers 74, 75 which are larger monofilament fibers. The axis 65 of the first cylindrical member 64 is connected to an electric motor not shown which provides means for rotating the first cyclindrical member in the direction of the arrow 77. Similarly the axis 72 of the second cylindrical member 71 is attached to an electric motor not shown which provides a means for rotating the second cylindrical member 71 in a direction opposite to that of the first cylindrical member 64 and in the direction of the arrow 78. By virtue of this counter-rotation, the stiffer fibers 74, 75 brush out the particles 33, 34 from between the fibers 67, 68 permitting the particles 33, 34 to fall onto the web 31 (see FIG. 1).

The invention may be understood by reference to the following non-limiting examples. These examples are designed to teach those skilled in the art how to practice the invention and represent the best mode contemplated for practicing the invention. Unless otherwise specified, all parts and percentages are by weight.

EXAMPLE 1

A copolymer of vinyl chloride and vinylidene chloride available from the Dow Chemical Company, Midland, Mich. under the designation XP-5230.04 is mixed with diammonium phosphate in a weight ratio of 10:1 to form a powdered mixture. This mixture is added to a cotton web in the manner described above with respect to the drawings. This copolymer has a weight ratio of vinyl chloride to vinylidene chloride of 10:90, a chlorine content of 71%; a plasticizer content of 1%; a minimum particle size of 2 microns and a maximum particle size of 20 microns. The resultant batt has a high glow resistance, and a low residual glow time and a char length of 0.1 inches. The weight ratio of the copolymer to the web is 20:80.

EXAMPLES 2-6

The procedure of Example 1 is repeated except that the copolymer employed in Example 1 is replaced by that copolymer shown in column 2 of the attached Table I with similar results.

TABLE I

| Designation | Used In Ex. | Weight Ratio of Vinyl Chloride to Vinylidene Chloride | Chlorine Content (Wt. %) | cizer Content (Wt. %) | Plasti- Plasticizer Type (Designation) | Stabilizer Content (Wt. %) | Stabilizer Type (Designation) | Minimum Particle Size (μ) | Maximum Particle Size (μ) |
|---|---|---|---|---|---|---|---|---|---|
| XP-5230.04 | 1 | 10/90 | 71 | ≦1% | Citrate | None | — | 40[1] | 100[1] |
| XP-2384.49 | 2 | 10/90 | 71 | 6 | Citrate | 2 | Benzophenone | Standard Granulation (Not Micronized) | |
| XP-4174.19 | 3 | 15/85 | 70 | ≦1% | Citrate | None | — | Standard Granulation (Not Micronized) | |
| XP-5230.05 | 4 | 21/79 | 67 | ≦1% | Citrate | None | — | * | * |
| XP-5230.06 | 5 | 15/85 | 69 | ≦1% | Citrate | None | — | ** | ** |
| XP-5230.08 | 6 | 7/93 | 72 | 6.0 | Citrate | 1.0 | Epox. Soybean Oil | *** | *** |

Notes
[1]Actual particle size is as follows: through 60 on 200 mesh (75μ-250μ) 2% through 200 on 325 mesh (45μ-75μ) 77.8% through 325 mesh (less than 45 μ) 20%
*on 100 mesh (greater than 150μ) 14% thru 100, on 200 mesh (75μ to 150μ) 17% thru 200, on 325 mesh (45μ to 75μ) 30% thru 325 mesh (less than 45μ) 39%
**through 200 on 325 mesh (45μ-75μ) 4% through 325 mesh (less than 45μ) 96%
***typical customer audit over 40 microns - 10% maximum 1-40 microns - 90% minimum under 1 micron - 10% maximum Glow-resistance is measured by cutting a sample of the batt 6 inches × 8 inches. A piece of unbleached, untreated, cotton twill having 60 threads per inch is placed on top of the 48-square inch surface of the batt, and thumb-tacked to a board on which the batt was placed so that the batt is compressed with a force of about ½ pound per square inch. A 100mm-long lighted cigarette is placed on the twill and observed. The percent of the cigarette consumed when a glow is first noticed in the batt is termed the glow-resistance in percent. Glow-resistance is synonymous with cigarette resistance. This test is similar to but is different than federal specification FF4-72.

Char length is the distance in inches that the batt is charred, measured after the cigarette is completely consumed in the above-described test for glow-resistance. During all but the last few seconds of the burning of the cigarette it burns only on one end. However, when the other end is reached, there is a period of about one to two seconds during which the tobacco within the cigarette is being burned from all sides. This terminal burning generates the greatest amount of heat and provides the severest test of cigarette resistance. In order to be acceptable, a batt must cease glowing before the char has advanced more than one inch from the cigarette in any direction.

Although the invention has been described in considerable detail with reference to certain preferred embodiments thereof, it will be understood that variations and modifications can be effected within the spirit and scope of the invention as described above and as defined in the appended claims.

What is claimed is:

1. A process for producing a batt comprising the steps of:

I. forming a thin web fibers;

II. contacting the web with an adhesive amount of particles of a copolymer of vinyl chloride and vinylidene chloride;

III. contacting the web with an amount of diammonium phosphate wherein the eight ratio of copolymer to diammonium phosphate is 100:4 to 100:40;

IV. forming the web into a batt by laying the web transversely back and forth on a moving belt such that the batt comprises a plurality of webs; and then V. heating the batt to a temperature above the sticking point of the copolymer but below the degradation point of the fibers wherein the weight ratio of vinyl chloride to vinylidene chloride is 1:99 to 40:60 and wherein the weight ratio of the copolymer to the fibers is 1:99 to 30:70 and wherein the copolymer particles have a size range of from 1 to 200 microns.

2. The process of claim 1 wherein the thin web is horizontally disposed.

3. The process of claim 1 wherein the copolymer has a sticking point of 300° to 370° F.

4. The process of claim 1 wherein the temperature in step V is between 300° and 400° F.

5. The process of claim 1 wherein the heating is conducted for a period of from 1 to 20 minutes.

6. The process of claim 1 wherein the fibers are cotton.

7. The process of claim 1 wherein the fibers are a blend of cotton and polyester.

8. The process of claim 1 wherein the copolymer and the diammonium phosphate are contacted with the web in admixture with each other.

9. A completely dry process for producing a batt of high compressive strength comprising in sequence the steps of:

I. forming a horizontally disposed, thin, planar web of fibers;

II. contacting the web with particles of a copolymer of vinyl chloride and vinylidene chloride in admixture with diammonium phosphate while the web is in contact with and supported by a moving belt thereby inhibiting the passage of particles through the web;

A. wherein the weight ratio of vinyl chloride to vinylidene chloride is 5:95 to 25:75, B. wherein the weight ratio of the copolymer to the fibers is 10:90 to 20:80, C. wherein the copolymer particles have a size range of 5 microns to 50 microns, D. wherein the copolymer has a sticking point of 300° to 370° F, E. wherein the diammonium phosphate comprises from 2 to 4 weight percent of the batt, F. wherein the weight ratio of copolymer to diammonium phosphate is 100:8 to 100:20, G. wherein the particles are fed from a container onto a first rotating member which is then contacted with a counter-rotating brush having bristles which remove the particles from the first rotating member permitting the particles to fall on the web under the influence of gravity, III. passing the web and adhering particles through the nip of two rotating rolls to impress the particles into the web;

IV. forming the web into a batt by laying the web transversely back and forth on a moving belt such that the batt comprises a plurality of webs;

V. heating the batt to a temperature of 325° to 375° F for a period of 2 to 10 minutes while the batt is being passed through an oven between two parallel foraminous belts while hot air is forced through the belts and through the batt; thereby producing a glow-resistant batt of high compressive strength.

10. A glow-resistant fibrous batt comprising:

A. Fibers bonded at their intersections by melted particles of a copolyer vinyl chloride and vinylidene chloride and;

wherein the weight ratio of vinyl chloride to vinylidene chloride is 1:99 to 40:60 and wherein the weight ratio of the copolymer to the fibers is 1:99 to 30:70 and wherein the copolymer particles have a size range of from 1 to 200 microns B. Diammonium phosphate carried by the copolymer wherein the weight ratio of copolymer to diammonium phosphate is 100:4 to 100:40.

* * * * *